United States Patent [19]

Wales

[11] 4,278,065

[45] Jul. 14, 1981

[54] SLINGSHOT TYPE GUN

[75] Inventor: Richard L. Wales, Rogue River, Oreg.

[73] Assignees: Beverly A. Wales; Allen Wilkins, both of Rogue River, Oreg. ; part interest to each

[21] Appl. No.: 28,988

[22] Filed: Apr. 11, 1979

[51] Int. Cl.[3] ..... F41B 7/00

[52] U.S. Cl. ..... 124/20 R; 124/40; 124/35 R; 124/80

[58] Field of Search ..... 124/17, 16, 41 R, 35 R, 124/20 R, 40, 18

[56] References Cited

U.S. PATENT DOCUMENTS

| | | | |
|---|---|---|---|
| 1,844,756 | 2/1932 | Gillette | 124/18 |
| 2,040,150 | 5/1936 | Merrill | 124/17 X |
| 2,708,924 | 5/1955 | Hurlburt | 124/17 |
| 3,067,730 | 12/1962 | Merz | 124/40 X |
| 3,812,834 | 5/1974 | Saunders | 124/20 R |
| 3,857,379 | 12/1974 | Burghardt | 124/35 R X |

*Primary Examiner*—Richard C. Pinkham
*Assistant Examiner*—William R. Browne
*Attorney, Agent, or Firm*—James D. Givnan, Jr.

[57] ABSTRACT

A gun utilizing an elongate elastic component to propel a projectile. A gun stock mounts at its forward end the elastic component. A release mechanism on the stock is located approximately at the normal trigger location. The release mechanism is embodied within stock attached members with one member being movable to effect release of the tensioned elastic member and projectile therein. The release mechanism includes a sight opening along with a bail shaped safety to prevent inadvertent projectile release.

6 Claims, 3 Drawing Figures

SLINGSHOT TYPE GUN

BACKGROUND OF THE INVENTION

The present invention relates generally to guns and particularly to a type of gun utilizing an elastic member to propel the projectile.

The present invention is somewhat akin to the well known slingshot in that the gun includes an elongate elastic member, secured at its forward end, and stretchable for the purpose of launching the projectile.

The slingshot is not normally regarded as having a high degree of accuracy as same is adversely affected by any vertical or lateral movement of either of the shooter's hands at the time of projectile release.

SUMMARY OF THE PRESENT INVENTION

The present invention is embodied within a gun having a base resembling a gun stock and an elastic component for stretched engagement with a release mechanism.

The gun base is fitted at its forward end with a pair of supports to each of which is secured one end of an elastic component, preferably elastic tubing, adapted at its mid-point to receive a projectile such as a small metal ball. Fixed at a point along said base is a release mechanism which includes a pivoted member actuatable by the operator to release the elastic component and projectile therein. For purposes of aiming, the release mechanism may include a sight opening and additionally, indices to indicate the proper positioning of the elastic component with the release mechanism. A safety on the release mechanism prevents inadvertent release. The release mechanism includes a pivoted member movable relative a stationary, second member to permit "firing" by gradual gripping of the mechanism.

Important objects of the present gun include the provision of a gun utilizing an elastic component capable of forcefully propelling a projectile with a high degree of accuracy a considerable distance; the provision of a gun utilizing an elastic component and having a release mechanism actuated by gripping of release mechanism members in a gradual manner so as not to adversely affect accuracy; the provision of a gun including a release mechanism defining an aperture constituting a sight; the provision of a gun having a release mechanism with indices thereon to indicate the proper position for a segment of the tensioned elastic component gripped between release mechanism members; the provision of a gun utilizing an elongate elastic component secured at its forward end to a pair of rearwardly curved supports having segments in telescopic engagement with the ends of said elastic component.

DETAILED DESCRIPTION OF THE PREFERRED EMBODIMENT

Figure 1:
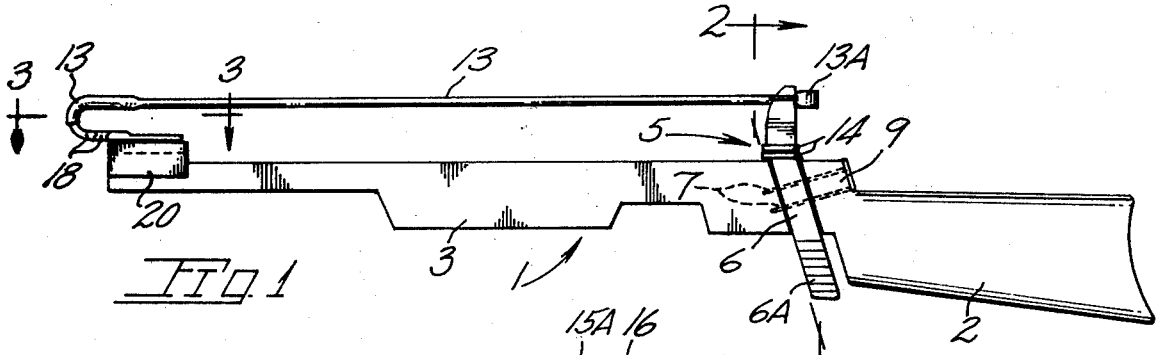
FIG. 1 is a side elevational view of the present gun.

With continuing attention to the drawing, the reference numeral 1 indicates generally the present gun shown in the general configuration of a rifle having a stock 2 the forearm 3 of which constitutes a hand grip. The stock is sometimes hereinafter referred to as a base.

Figure 2:
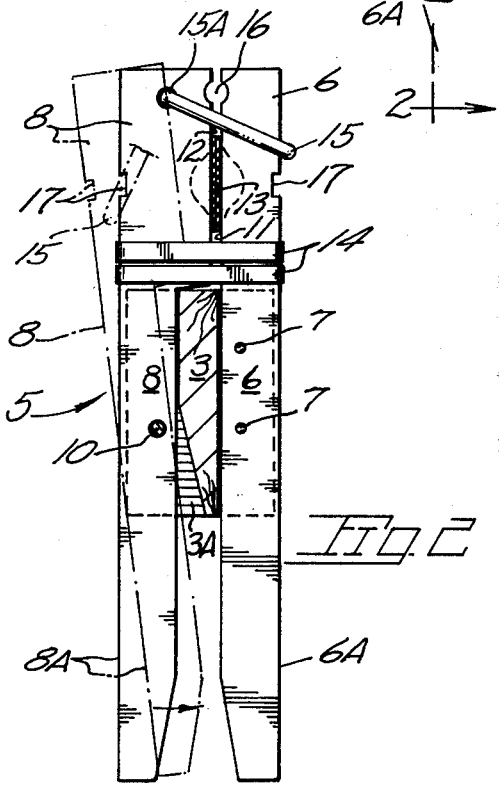
FIG. 2 is a vertical sectional view taken along line 2—2 of FIG. 1.
Figure 3:
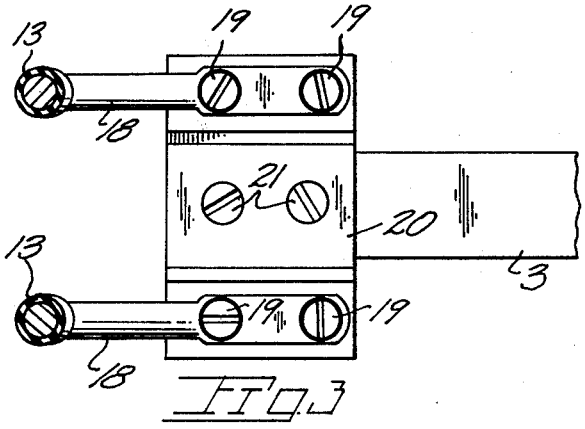
FIG. 3 is a horizontal sectional view taken along line 3—3 of FIG. 1.

With attention primarily to FIG. 2, the gun stock is adapted along opposite sides for the purpose of receiving a release mechanism indicated generally at 5. The release mechanism is located so as to correspond to that area normally occupied by a gun trigger mechanism. A stationary member 6 of the release mechanism is secured to the gunstock by fastener pins 7. A movable member 8 of the release mechanism is retained in place by means of a pivot pin 10. Pins 7 and pivot pin 10 are inserted from the combe portion 9 of the gun. Both of said members extend below the gunstock to provide handgrips 6A–8A. Stationary and movable release members 6 and 8 also extend above the stock and include opposed surfaces 11 and 12 between which a segment of stretched elastic component 13 may be retained.

Rubber bands at 14 urge the members of the release mechanism toward the closed position shown. Movable member 8, upon gripping by the shooter, causes surface 12 to move away from surface 11 permitting passage or "firing" of the component-carried projectile.

Release mechanism 5 also includes a bail or latch 15 pivotally mounted at one end 15A and engageable at its opposite end with stationary member 6 to prevent inadvertent opening movement of member 8. Such a bail arrangement constitutes a "safety" for the gun. Indicated at 16 is an aperture through which the shooter may view the target, the aperture may be in the nature of a peep sight. To assure proper vertical positioning of portion 13A of the elastic component carrying the projectile within the release mechanism, I provide a pair of indices 17 in the form of notches.

At the forward end of base 1 are a pair of supports 18 which curve upwardly and rearwardly to receive the encompassing forward end of elastic component 13. To assure against slipping of the tubular elastic component, the supports 17 may be dabbed with alcohol. Each support 18 is secured by fasteners 19 fitted within a block 20 affixed to the forward end of the base by fasteners 21.

Operation of the gun is believed obvious from the foregoing description. Unusual accuracy is realized in that a sight is provided the shooter. Also contributing toward accuracy is the gradual release of the projectile upon the gripped portions 6A and 8A being moved toward one another. The gun may be safely carried in a "loaded" condition by reason of the bail shaped safety 15 preventing opening movement of the release mechanism. The indices at 17 also contribute toward accuracy by facilitating proper positioning of the projectile within the release mechanism.

As shown in FIG. 2, base 3 is recessed at 3A to permit release member 8 to move in a plane substantially normal to the base about pivot pin 10.

While I have shown but one embodiment of the invention it will be apparent to those skilled in the art that the invention may be embodied still otherwise without departing from the spirit and scope of the invention.

Having thus described the invention, what is claimed and desired to be secured under a Letters Patent is:

1. A slingshot type gun comprising, a gun stock, an elongate elastic component mounted to the forward end of said gun stock and adapted to receive a projectile, and an elastic component release means for momentary retention of a projectile within a doubled back segment of said elastic component, said means including a manually movable member pivotally attached to the gun stock for movement transversely of the longitudinal axis of the gun and said member being elongated and extending above and below the gun stock and swingable relative the remainder of the means for release of the elastic component and projectile, said manually movable means further including another elongated upright but stationary member also extending above and below the gun stock and coacting with said movable member to retain a projectile and the tensioned elongate component preparatory to release, those portions of said movable and stationary members below the gun stock constituting handgrips.

2. The gun claimed in claim 1 wherein said release means includes a safety latch engageable with said movable member preventing projectile releasing pivotal movement thereof.

3. The gun claimed in claim 2 wherein said release means defines an aperture functioning as a gun sight.

4. The gun claimed in claim 3 wherein said release means has indices for indicating the proper position of the elastic component and projectile when in retained engagement with said release means.

5. The gun claimed in claim 4 wherein said movable member is swingable in a plane transverse to said gun stock.

6. The gun claimed in claim 5 additionally including resilient means urging opposed surfaces of the movable and stationary members toward one another to retain the elastic component and projectile preparatory to release.

* * * * *